US010520232B2

(12) United States Patent
Liebendorfer et al.

(10) Patent No.: US 10,520,232 B2
(45) Date of Patent: Dec. 31, 2019

(54) LOW CHARGE PACKAGED REFRIGERATION SYSTEMS

(71) Applicant: Evapco, Inc., Taneytown, MD (US)

(72) Inventors: Kurt Liebendorfer, Taneytown, MD (US); Gregory S. Derosier, Eldersburg, MD (US); Trevor Hegg, Westminster, MD (US)

(73) Assignee: Evapco, Inc., Taneytown, MD (US)

( * ) Notice: Subject to any disclaimer, the term of this patent is extended or adjusted under 35 U.S.C. 154(b) by 0 days.

(21) Appl. No.: 15/688,918

(22) Filed: Aug. 29, 2017

(65) Prior Publication Data

US 2018/0045444 A1 Feb. 15, 2018

Related U.S. Application Data

(62) Division of application No. 14/791,033, filed on Jul. 2, 2015, now Pat. No. 9,746,219.

(Continued)

(51) Int. Cl.

*F25B 43/00* (2006.01)
*F25B 1/00* (2006.01)

(Continued)

(52) U.S. Cl.

CPC ..... *F25B 43/00* (2013.01); *F25B 1/005* (2013.01); *F25B 33/00* (2013.01); *F25B 41/00* (2013.01); *F25D 13/00* (2013.01); *F25D 21/12* (2013.01); *F25D 23/006* (2013.01); *F25B 5/02* (2013.01); *F25B 40/00* (2013.01); *F25B 2400/05* (2013.01); *F25B 2400/071* (2013.01); *F25B 2400/13* (2013.01); *F25B 2400/23* (2013.01);

(Continued)

(58) Field of Classification Search

CPC ..... F25B 40/00–06; F25B 43/00–043; F25B 41/00; F25B 2400/13; F25B 2700/21175; F25B 2400/071; F25B 2400/05; F25D 23/006; F25D 21/12

See application file for complete search history.

(56) References Cited

U.S. PATENT DOCUMENTS 1,866,992 A * 7/1932 Zieber ..... F25B 5/02 62/117
4,059,968 A 11/1977 Ross (Continued)

FOREIGN PATENT DOCUMENTS

WO 2013053913 4/2013

OTHER PUBLICATIONS

International Search Report issued in corresponding International Patent Application No. PCT/US15/39111 dated Oct. 15, 2015.

*Primary Examiner* — Kun Kai Ma
(74) *Attorney, Agent, or Firm* — Evapco, Inc.; Peter J. Davis

(57) ABSTRACT

A packaged, pumped liquid, recirculating refrigeration system with charges of 10 lbs or less of refrigerant per ton of refrigeration capacity. The compressor and related components are situated in a pre-packaged modular machine room, and in which the condenser is mounted on the machine room and the evaporator is close coupled to the pre-packaged modular machine room. Prior art large receiver vessels may be replaced with a single or dual phase cyclonic separator also housed in the pre-packaged modular machine room.

6 Claims, 13 Drawing Sheets

Related U.S. Application Data

(60) Provisional application No. 62/020,271, filed on Jul. 2, 2014.

(51) Int. Cl.

| | |
|---|---|
| ***F25D 21/12*** | (2006.01) |
| ***F25B 33/00*** | (2006.01) |
| ***F25B 41/00*** | (2006.01) |
| ***F25D 13/00*** | (2006.01) |
| ***F25D 23/00*** | (2006.01) |
| ***F25B 5/02*** | (2006.01) |
| ***F25B 40/00*** | (2006.01) |

(52) U.S. Cl.
CPC . *F25B 2700/197* (2013.01); *F25B 2700/1933* (2013.01); *F25B 2700/21151* (2013.01); *F25B 2700/21175* (2013.01)

(56) References Cited

U.S. PATENT DOCUMENTS 4,139,052 A * 2/1979 Lackey ..... F24F 1/02 165/137
4,324,106 A 4/1982 Ross et al.
4,625,523 A * 12/1986 Toub ..... F25B 31/004 62/193
4,972,678 A 11/1990 Finlayson
5,189,882 A * 3/1993 Morgan, Sr. ..... F25B 45/00 62/292
5,189,885 A 3/1993 Ni
5,435,149 A 7/1995 Strong et al.
5,440,894 A * 8/1995 Schaeffer ..... F25B 1/00 62/203
5,619,861 A 4/1997 Yamanaka et al.
5,692,389 A 12/1997 Lord et al.
5,743,102 A * 4/1998 Thomas ..... A47F 3/04 165/219
6,009,715 A * 1/2000 Sakurai ..... F25B 39/04 62/125
6,128,911 A * 10/2000 Mathews ..... A47F 3/0408 62/256
6,381,972 B1 * 5/2002 Cotter ..... A47F 3/0439 62/126
6,560,986 B1 5/2003 Welch
6,988,538 B2 * 1/2006 Merkys ..... F25B 39/04 165/122
9,622,378 B2 * 4/2017 Hahn ..... F24F 13/20
2009/0217679 A1 9/2009 Raghavachari
2010/0229587 A1 * 9/2010 Liu ..... F24F 3/065 62/335
2011/0023515 A1 * 2/2011 Kopko ..... F28D 21/0017 62/222
2011/0167865 A1 * 7/2011 Morimoto ..... F24F 3/06 62/513
2013/0283833 A1 10/2013 Huff et al.
2014/0283538 A1 9/2014 Derosier
2016/0327293 A1 * 11/2016 Grabowski ..... F24F 11/30

* cited by examiner

25 TR FREEZER UNIT

- RECIRCULATED TOP FEED 1.2:1
- CYCLONE SEPARATION
- GLYCOL DEFROST
- CONVENTIONAL OIL SEPARATION
- EXTERNAL OIL COOLING IN CONDENSER
- FLASH ECONOMIZED
- CHARGE KEPT IN ECONOMIZER
- ADIABATIC MATS ON CONDENSER

| LEGEND | |
|---|---|
| AD | AMMONIA DETECTOR |
| COR | COMPRESSOR OIL RETURN |
| COS | COMPRESSOR OIL SUPPLY |
| CV | CONTROL VALVE |
| DRN | DRAIN |
| FX | FLEX CONNECTION |
| GLS | GLYCOL LIQUID SUPPLY |
| GLR | GLYCOL LIQUID RETURN |
| HV | HAND ISOLATION VALVE |
| HT | HUMIDITY TRANSMITTER |
| IPV | INTERMEDIATE PRESSURE VAPOR |
| HPV | HIGH PRESSURE VAPOR |
| LPV | LOW PRESSURE VAPOR |
| LPL | LOW PRESSURE PUMPED LIQUID |
| OS | COMPRESSOR OIL SYSTEM |
| PSV | PRESSURE SAFETY VALVE |
| PI | PRESSURE INDICATOR (GAGE) |
| PT | PRESSURE TRANSMITTER |
| RLF | RELIEF |
| ST | STRAINER |
| TI | TEMPERATURE INDICATOR |
| TT | TEMPERATURE TRANSMITTER |
| TW | TEMPERATURE WELL |

Fig. 2

- Solutions include single modules and two separate modules
- Facilitates Split System Design

- 10 to 100 TR
- -20°F to 50°F Room Temperature
- Hot Gas or Air Defrost
- Rooftop installation
- Air-cooled or Water-cooled
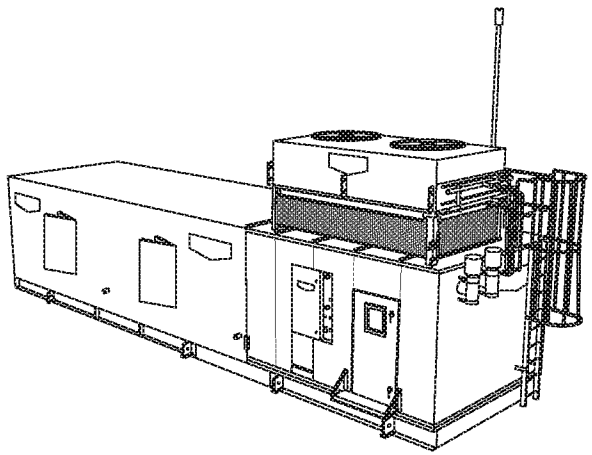
| LOW TEMPERATURE SYSTEMS | MEDIUM TEMPERATURE SYSTEMS | HIGH TEMPERATURE SYSTEMS |
|---|---|---|
| -30F to OF SST | 0F TO 28 F SST | 25F TO 40F SST |
| Economized | Economized | Non-Economized |
| Hot Gas Defrost | Hot Gas Defrost | Air Defrost |
| Nominal Standard Capacities (TR) | | |
| 10 | 10 | 10 |
| 15 | 15 | 15 |
| 20 | 20 | 20 |
| 25 | 25 | 25 |
| 30 | 30 | 30 |
| 40 | 40 | 50 |
| 50 | 50 | 75 |
| 60 | 70 & 90 | 100 |
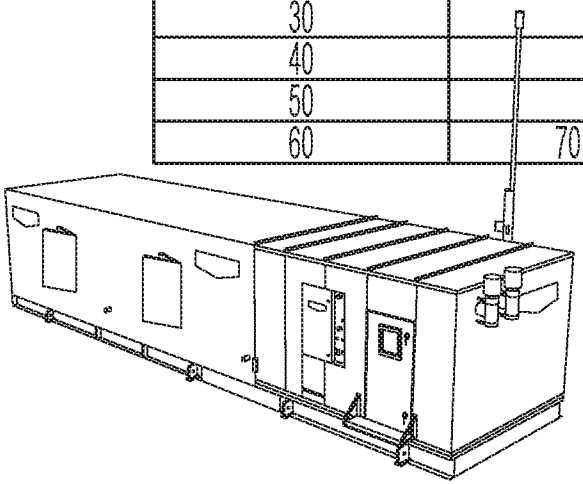
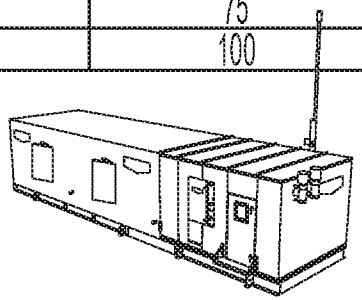
FIG. 11

MACHINE ROOM MODULE

- Completely piped, wired, tested & insulated
  - 95% of all piping is Stainless Steel
- Provides Required Machine Room:
  - Maintenance access
  - Ammonia detection
  - Safety controls
  - Safety relief system
  - Ventilation

- Microprocessor control system for entire unit
- Insulated "Superfloor", directly on refrigerated space

LOW CHARGE PACKAGED REFRIGERATION SYSTEMS

FIELD OF THE INVENTION

The present invention relates to industrial refrigeration systems.

BACKGROUND OF THE INVENTION

Prior art industrial refrigeration systems, e.g., for refrigerated warehouses, especially ammonia based refrigeration systems, are highly compartmentalized. The evaporator coils are often ceiling mounted in the refrigerated space or collected in a penthouse on the roof of the refrigerated space, the condenser coils and fans are usually mounted in a separate space on the roof of the building containing the refrigerated space, and the compressor, receiver tank(s), oil separator tank(s), and other mechanical systems are usually collected in a separate mechanical room away from public spaces. Ammonia-based industrial refrigeration systems containing large quantities of ammonia are highly regulated due to the toxicity of ammonia to humans, the impact of releases caused by human error or mechanical integrity, and the threat of terrorism. Systems containing more than 10,000 lbs of ammonia require EPA's Risk Management Plan (RMP) and OSHA's Process Safety Management Plan and will likely result in inspections from federal agencies. California has additional restrictions/requirements for systems containing more than 500 lbs of ammonia. Any refrigeration system leak resulting in the discharge of 100 lbs or more of ammonia must be reported to the EPA.

DESCRIPTION OF THE DRAWINGS

FIG. 2 is a blow-up of the upper left hand portion of FIG. 1.

FIG. 11 shows three-dimensional perspective views of three different embodiments of combined evaporator module and a prepackaged modular machine room, in which the embodiment on the left includes a roof mounted air-cooled condenser system.

SUMMARY OF THE INVENTION

Figure 1:
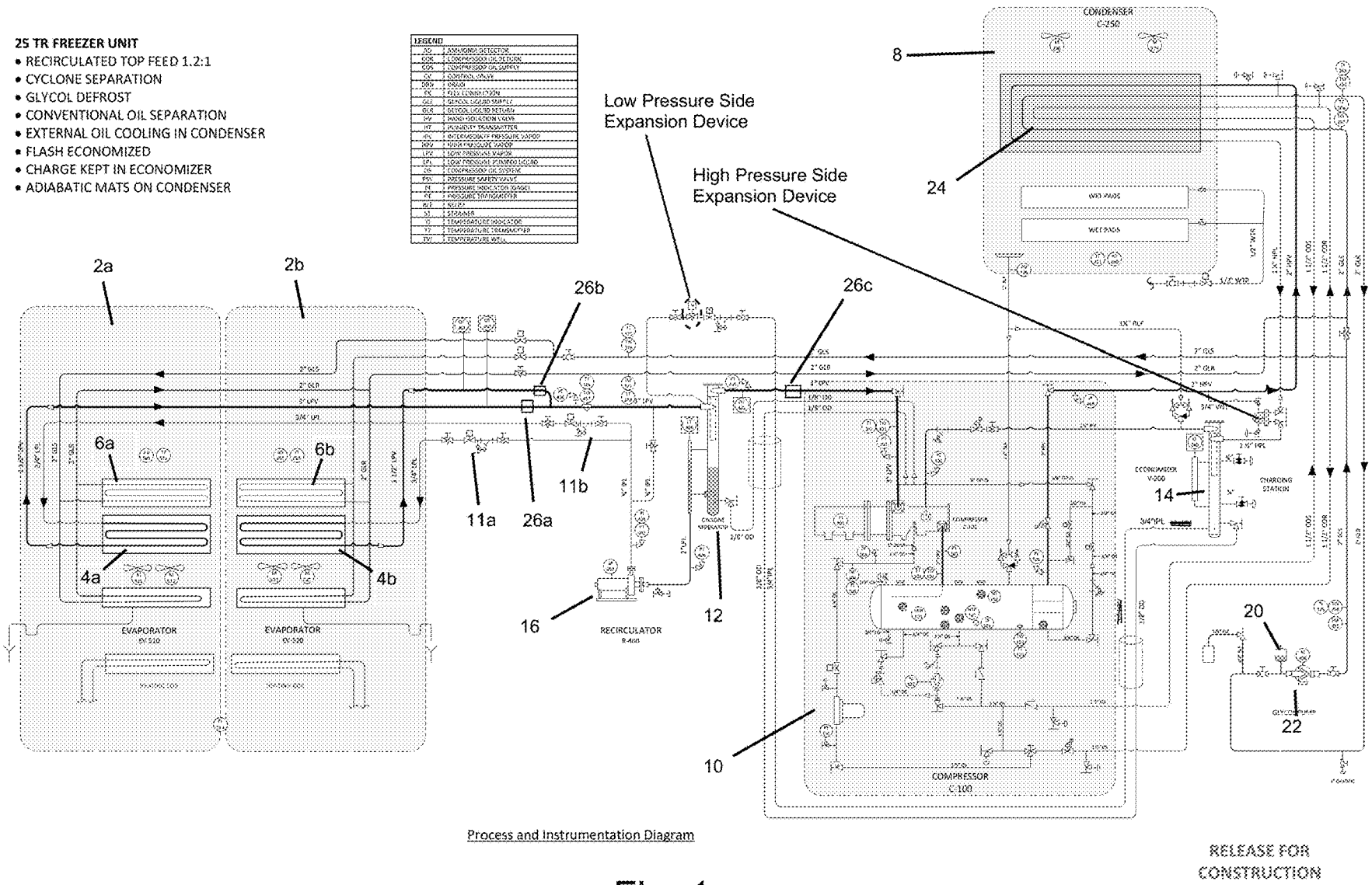
FIG. 1 is a schematic of a refrigeration system according to an embodiment of the invention.
Figure 3:
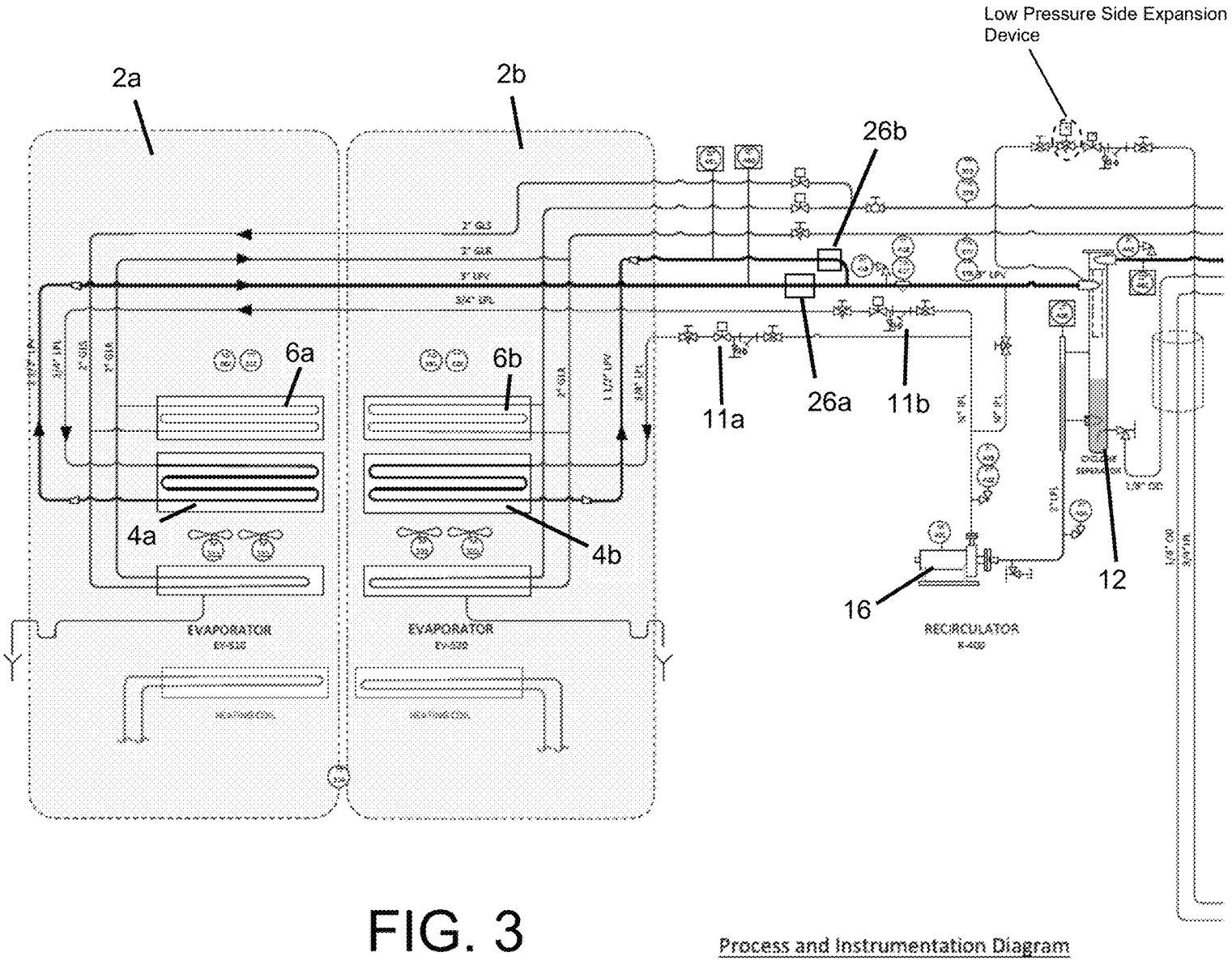
FIG. 3 is a blow-up of the lower left hand portion of FIG. 1.
Figure 4:
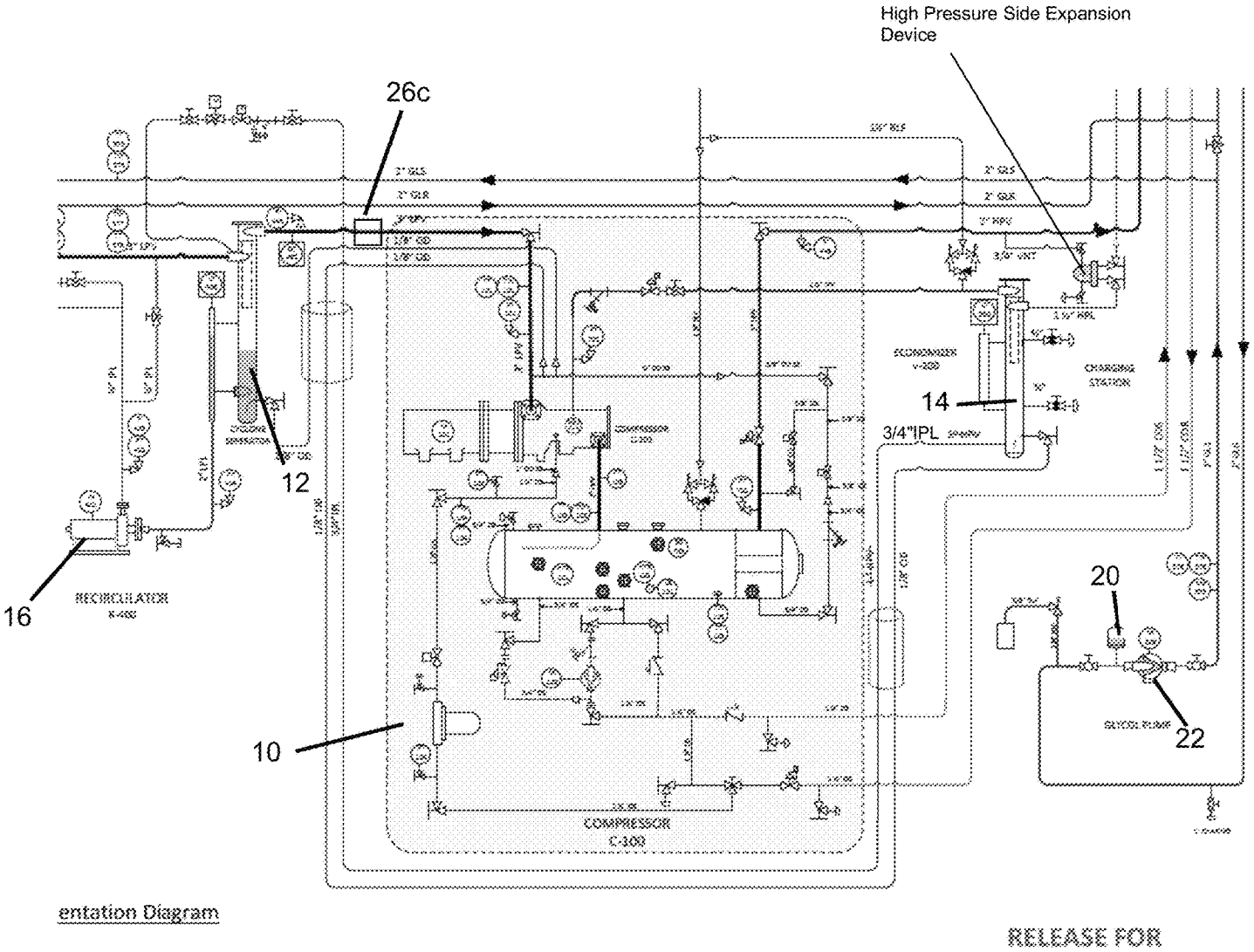
FIG. 4 is a blow-up of the lower right hand portion of FIG. 1.
Figure 5:
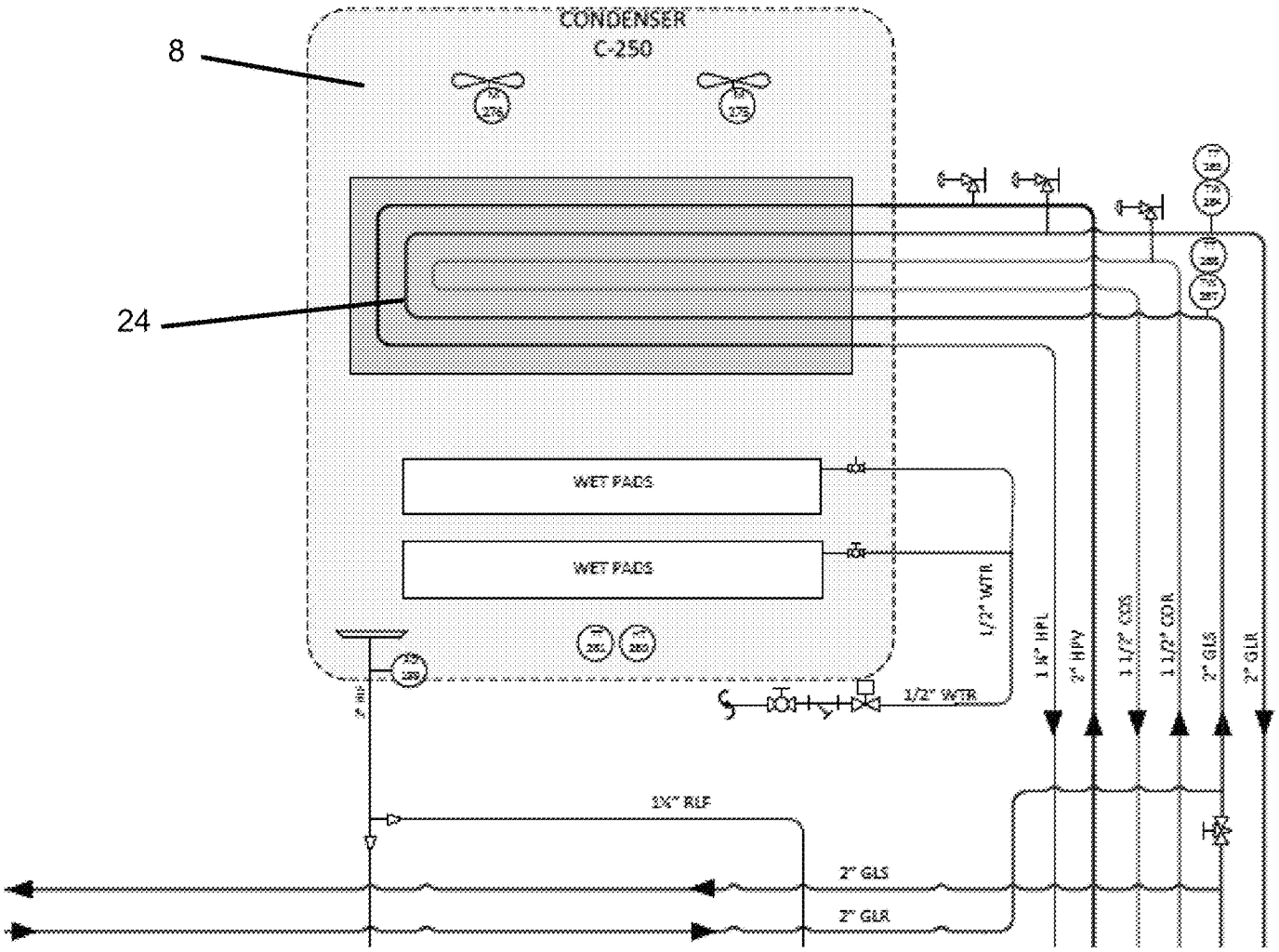
FIG. 5 is a blow up of the upper right hand portion of FIG. 1.

The present invention is a packaged, pumped liquid, recirculating refrigeration system with charges of 10 lbs or less of refrigerant per ton of refrigeration capacity. The present invention is a low charge packaged refrigeration system in which the compressor and related components are situated in a pre-packaged modular machine room, and in which the condenser is close coupled to the pre-packaged modular machine room. According to an embodiment of the invention, the prior art large receiver vessels, which are used to separate refrigerant vapor and refrigerant liquid coming off the evaporators and to store backup refrigerant liquid, may be replaced with liquid-vapor separation structure/device which is housed in the pre-packaged modular machine room. According to one embodiment, the liquid-vapor separation structure/device may be a single or dual phase cyclonic separator. According to another embodiment of the invention, the standard economizer vessel (which collects liquid coming off the condenser) can also optionally be replaced with a single or dual phase cyclonic separator, also housed in the pre-packaged modular machine room. The evaporator coil tubes are preferably formed with internal enhancements that improve the flow of the refrigerant liquid through the tubes, enhance heat exchange and reduce refrigerant charge. According to one embodiment, the condenser may be constructed of coil tubes preferably formed with internal enhancements that improve the flow of the refrigerant vapor through the tubes, enhance heat exchange and reduce refrigerant. According to a more preferred embodiment, the evaporator tube enhancements and the condenser tube enhancements are different from one-another. The specification of co-pending provisional application Ser. No. 62/188,264 entitled "Internally Enhanced Tubes for Coil Products" is incorporated herein in its entirety. According to an alternative embodiment, the condenser system may employ microchannel heat exchanger technology. The condenser system may be of any type known in the art for condensing refrigerant vapor into liquid refrigerant.

According to various embodiments, the system may be a liquid overfeed system, or a direct expansion system, but a very low charge or "critically charged" system is most preferred with an overfeed rate (the ratio of liquid refrigerant mass flow rate entering the evaporator versus the mass flow rate of vapor required to produce the cooling effect) of 1.05:1.0 to 1.8:1.0, and a preferred overfeed rate of 1.2:1. In order to maintain such a low overfeed rate, capacitance sensors, such as those described in U.S. patent application Ser. Nos. 14/221,694 and 14/705,781 the entirety of each of which is incorporated herein by reference, may be provided at various points in the system to determine the relative amounts of liquid and vapor so that the system may be adjusted accordingly. Such sensors are preferably located at the inlet to the liquid-vapor separation device and/or at the outlet of the evaporator, and/or someplace in the refrigerant line between the outlet of the evaporator and the liquid-vapor separation device and/or at the inlet to the compressor and/or someplace in the refrigerant line between the vapor outlet of the liquid-vapor separation device and the compressor.

Additionally, the condenser system and the machine room are preferably close-coupled to the evaporators. In the case of a penthouse evaporator arrangement, in which evaporators are situated in a "penthouse" room above the refrigerated space, the machine room is preferably connected to a pre-fabricated penthouse evaporator module. In the case of ceiling mounted evaporators in the refrigerated space, the integrated condenser system and modular machine room are mounted on a floor or rooftop directly above the evaporator units (a so-called "split system").

The combination of features as described herein provides a very low charge refrigeration system compared to the prior art. Specifically, the present invention is configured to require less than six pounds of ammonia per ton of refrigeration capacity. According to a preferred embodiment, the present invention can require less than four pounds of ammonia per ton of refrigeration. And according to most preferred embodiments, the present invention can operate efficiently with less than two pound per ton of refrigeration capacity. By comparison, prior art "stick-built" systems require 15-25 pounds of ammonia per ton of refrigeration, and prior art low charge systems require approximately 10 pounds per ton of refrigeration. Thus, for a 50 ton refrigeration system, prior art stick built systems require 750-1, 250 pounds of ammonia, prior art low charge systems require approximately 500 pounds of ammonia, and the present invention requires less than 300 pounds of ammonia, and preferably less than 200 pounds of ammonia, and more preferably less than 100 pounds of ammonia, the report threshold for the EPA (assuming all of the ammonia in the system were to leak out). Indeed according to a 50 ton refrigeration system of the present invention, the entire amount of ammonia in the system could be discharged into the surrounding area without significant damage or harm to humans or the environment.

DETAILED DESCRIPTION OF THE INVENTION

FIG. 1 is a process and instrumentation diagram for a low charge packaged refrigeration system according to an embodiment of the invention. Blow-ups of the four quadrants of FIG. 1 are presented in FIGS. 2 through 5, respectively. The system includes evaporators 2*a* and 2*b*, including evaporator coils 4*a* and 4*b*, respectively, condenser 8, compressor 10, expansion devices 11*a* and 11*b* (which may be provided in the form of valves, metering orifices or other expansion devices), pump 16, liquid-vapor separation device 12, and economizer 14. According to one embodiment, liquid-vapor separation device 12 may be a recirculator vessel. According to other embodiments, liquid-vapor separation device 12 and economizer 14 may one or both provided in the form of single or dual phase cyclonic separators. The foregoing elements may be connected using standard refrigerant tubing in the manner shown in FIGS. 1-5. As used herein, the term "connected to" or "connected via" means connected directly or indirectly, unless otherwise stated. Optional defrost system 18 includes glycol tank 20, glycol pump 22, glycol condenser coils 24 and glycol coils 6*a* and 6*b*, also connected to one-another and the other element of the system using refrigerant tubing according to the arrangement shown in FIG. 1. According to other optional alternative embodiments, hot gas or electric defrost systems may be provided. An evaporator feed pump/recirculator 16 may also be provided to provide the additional energy necessary to force the liquid refrigerant through the evaporator heat exchanger.

Figure 6:
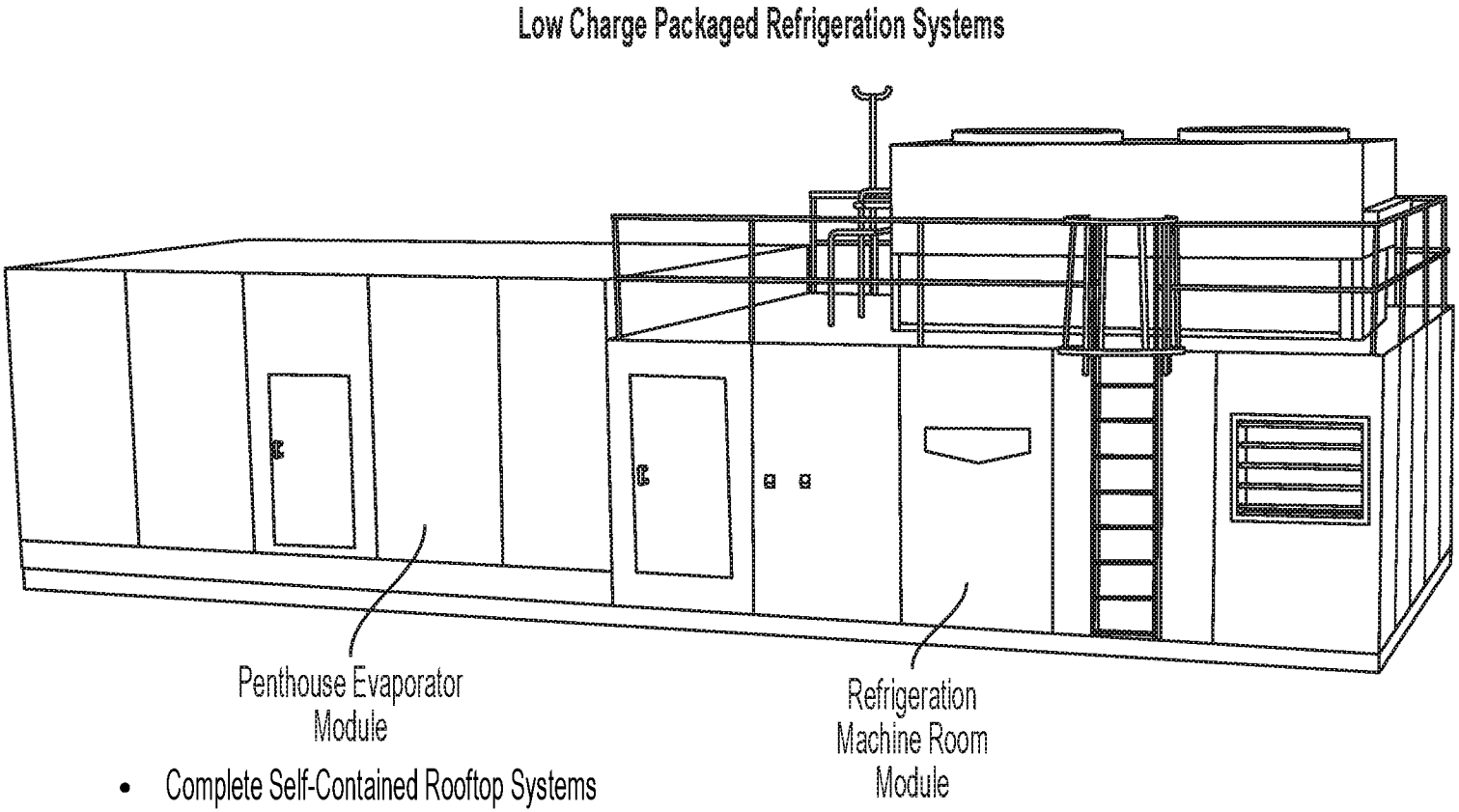
FIG. 6 is a three dimensional perspective view of a combined evaporator module and a prepackaged modular machine room according to an embodiment of the invention.
Figure 7:
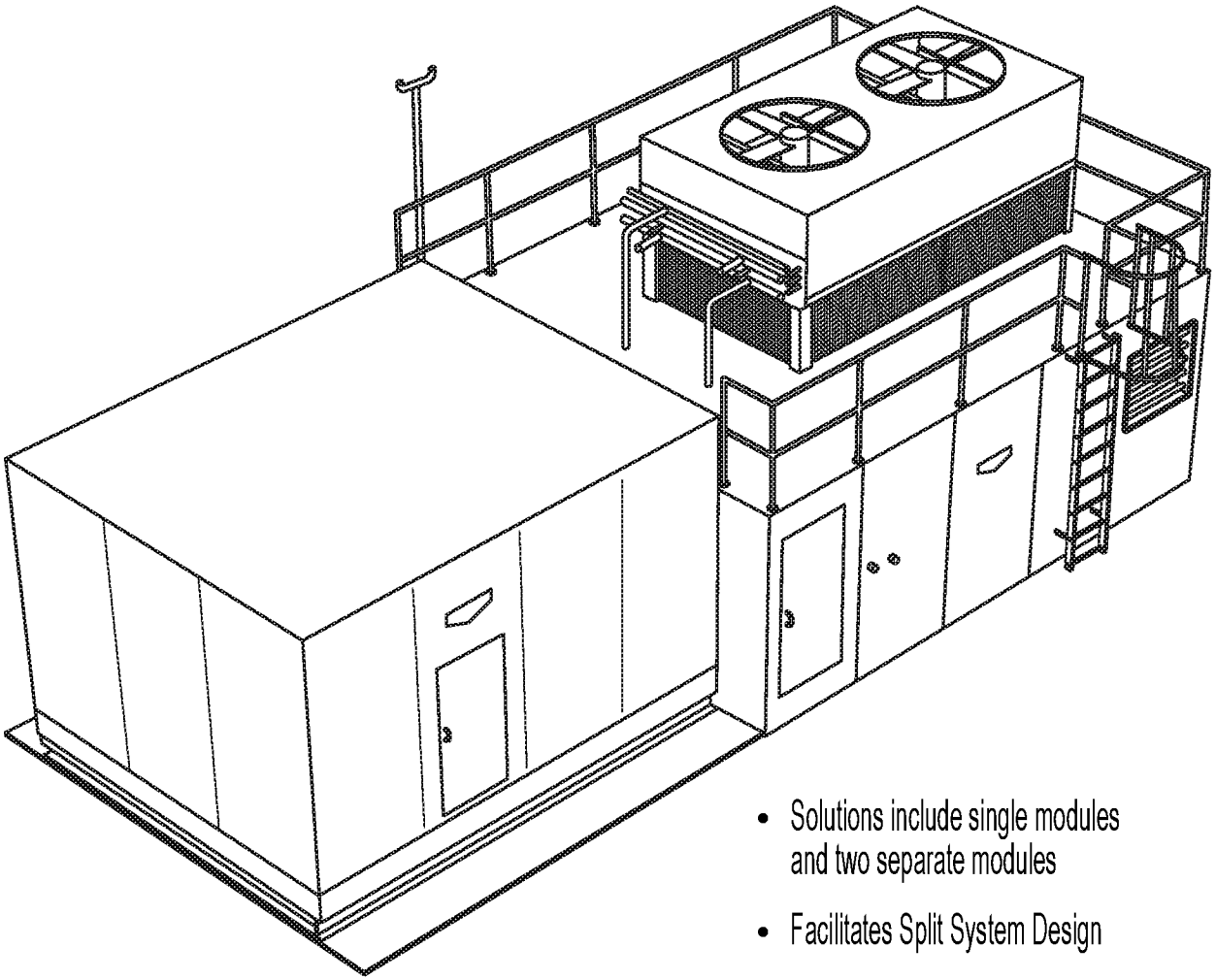
FIG. 7 is a three dimensional perspective view of a combined evaporator module and a prepackaged modular machine room according to another embodiment of the invention.
Figure 10:
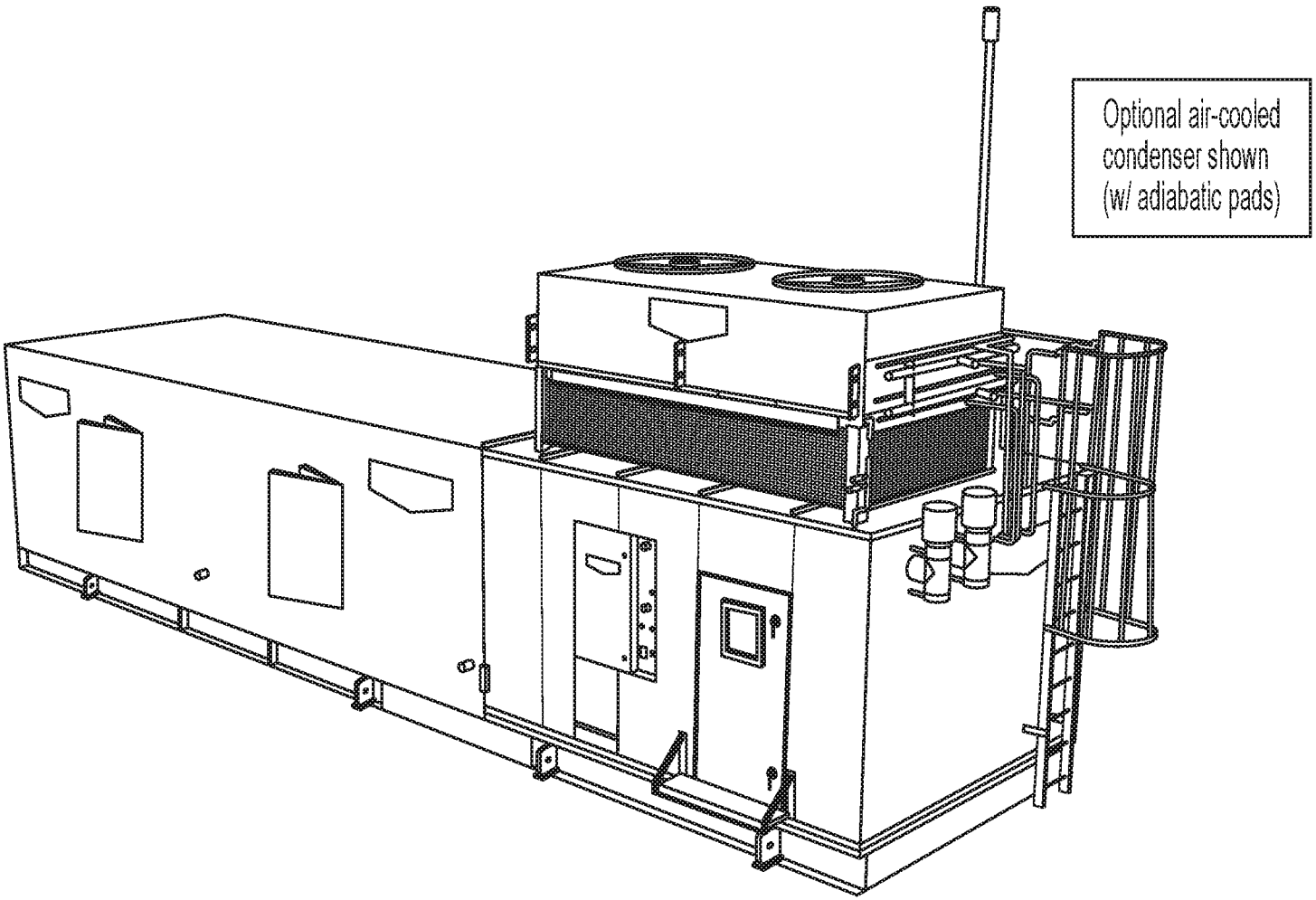
FIG. 10 is a three dimensional perspective view of combined evaporator module and a prepackaged modular machine room according to another embodiment of the invention.

According to the embodiment shown in FIGS. 1-5, low pressure liquid refrigerant ("LPL") is supplied to the evaporator by pump 16 via expansion devices 11. The refrigerant accepts heat from the refrigerated space, leaves the evaporator as low pressure vapor ("LPV") and liquid and is delivered to the liquid-vapor separation device 12 (which may optionally be a cyclonic separator) which separates the liquid from the vapor. Liquid refrigerant ("LPL") is returned to the pump 16, and the vapor ("LPV") is delivered to the compressor 10 which condenses the vapor and sends high pressure vapor ("HPV") to the condenser 8 which compresses it to high pressure liquid ("HPL"). The high pressure liquid ("HPL") is delivered to the economizer 14 which improves system efficiency by reducing the high pressure liquid ("HPL") to intermediate pressure liquid "IPL" then delivers it to the liquid-vapor separation device 12, which supplies the pump 16 with low pressure liquid refrigerant ("LPL"), completing the refrigerant cycle. The glycol flow path (in the case of optional glycol defrost system) and compressor oil flow path is also shown in FIGS. 1-5, but need not be discussed in more detail here, other than to note that the present low charge packaged refrigeration system may optionally include full defrost and compressor oil recirculation sub-systems within the packaged system. FIGS. 1-5 also include numerous control, isolation, and safety valves, as well as temperature and pressure sensors (a.k.a. indicators or gages) for monitoring and control of the system. In addition, optional sensors 26*a* and 26*b* may be located downstream of said evaporators 2*a* and 2*b*, upstream of the inlet to the liquid-vapor separation device 12, to measure vapor/liquid ratio of refrigerant leaving the evaporators. According to alternative embodiments, optional sensor 26*c* may be located in the refrigerant line between the outlet of the liquid-vapor separation device 12 and the inlet to the compressor 10. Sensors 26*a*, 26*b* and 26*c* may be capacitance sensors of the type disclosed in U.S. Ser. Nos. 14/221,694 and 14/705,781, the disclosures of which are incorporated herein by reference, in their entirety. FIG. 6 shows an example of a combined penthouse evaporator module and a prepackaged modular machine room according to an embodiment of the invention. According to this embodiment, the evaporator is housed in the evaporator module, and the remaining components of the system shown in FIGS. 1-5 are housed in the machine room module. Various embodiments of condenser systems that may be employed according to the invention include evaporative condensers, with optional internally enhanced tubes, air cooled fin and tube heat exchangers with optional internal enhancements, air cooled microchannel heat exchangers, and water cooled heat exchangers. In the case of air cooled condenser systems, the condenser coils and fans may be mounted on top of the machine room module for a complete self-contained rooftop system. Other types of condenser systems may be located inside the machine room. According to this embodiment, the entire system is completely self-contained in two roof-top modules making it very easy for over-the-road transport to the install site, using e.g., flat bed permit load non-escort vehicles. The penthouse and machine room modules can be separated for shipping and/or for final placement, but according to a most preferred embodiment, the penthouse and machine room modules are mounted adjacent to one-another to maximize the reduction in refrigerant charge. According to a most preferred embodiment, the penthouse module and the machine room module are integrated into a single module, although the evaporator space is separated and insulated from the machine room space to comply with industry codes. FIGS. 7, 10 and 11 show other examples of adjacent penthouse evaporator modules and machine room modules.

Figure 8:
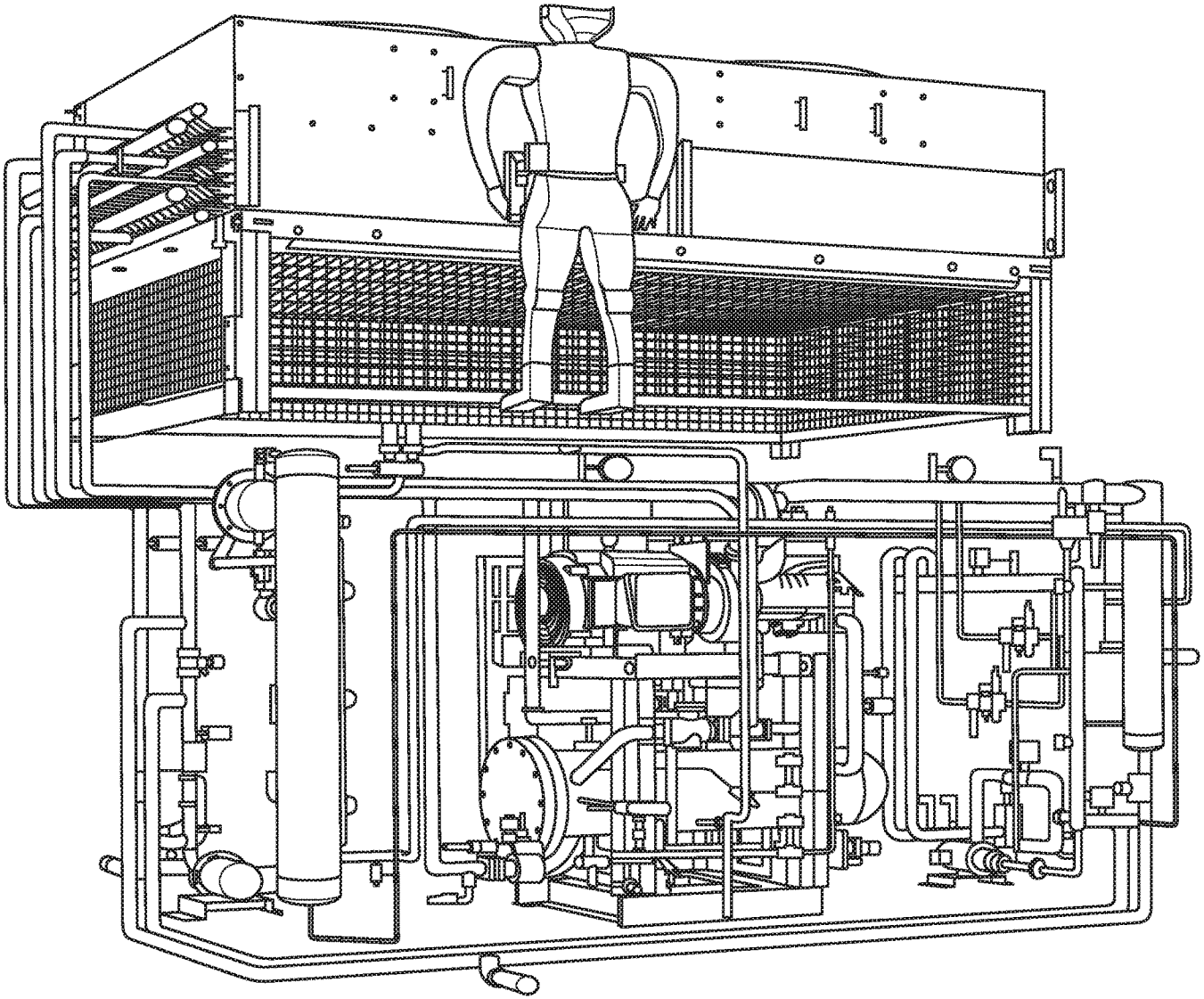
FIG. 8 is a three dimensional perspective view of the inside of a pre-packaged modular machine room and condenser unit according to an embodiment of the invention.
Figure 9:
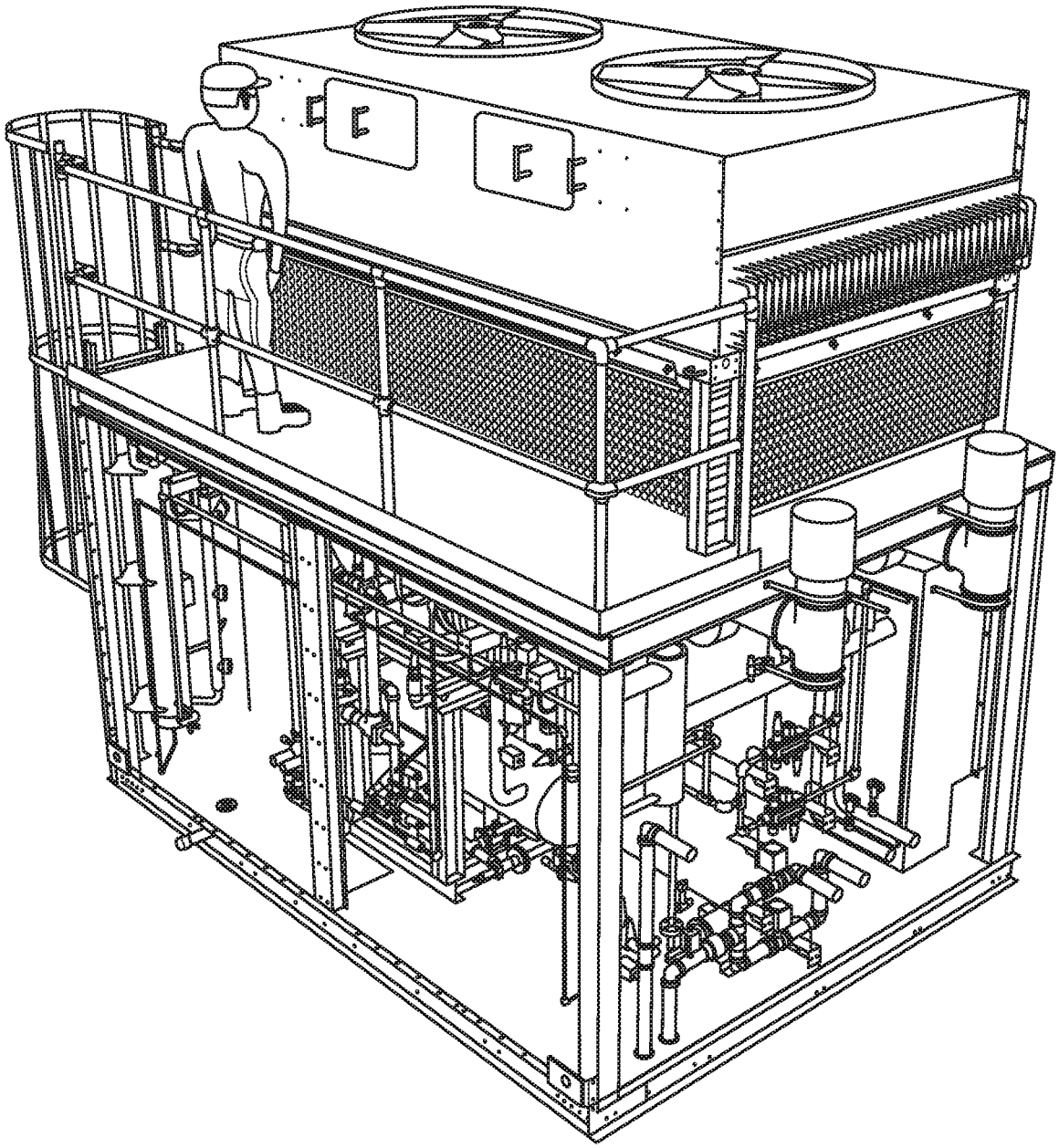
FIG. 9 is a three dimensional perspective view of the inside of a pre-packaged modular machine room and condenser unit according to another embodiment of the invention.
Figure 12:
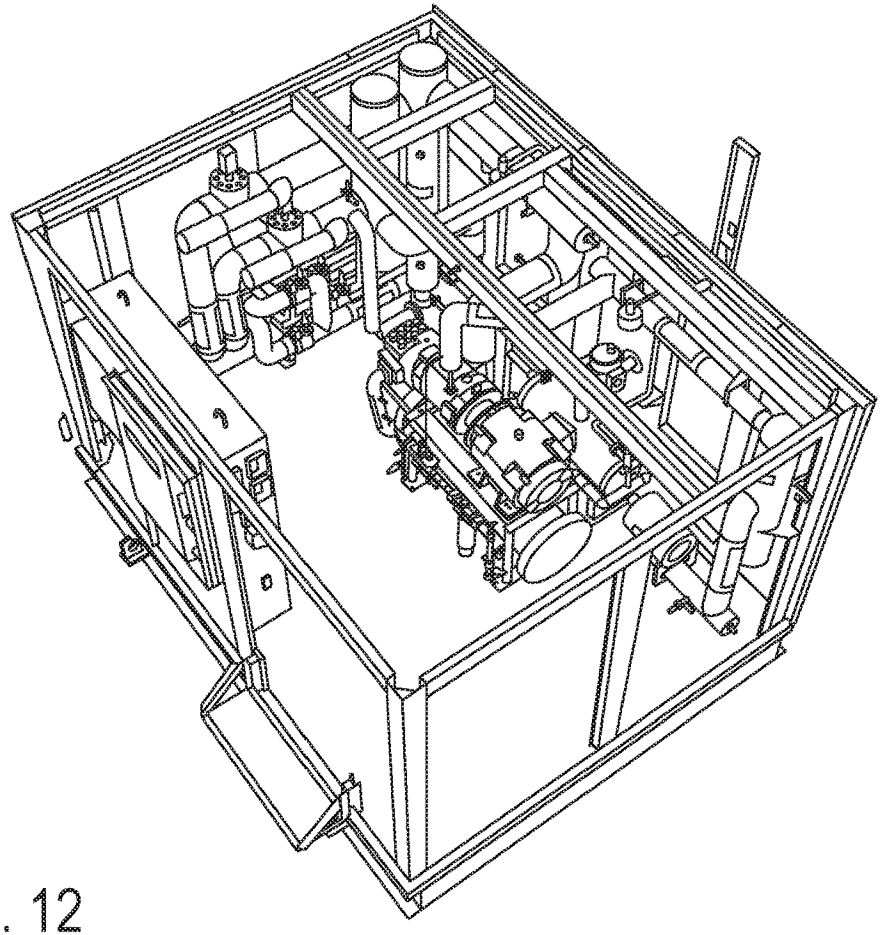
FIG. 12 shows a three-dimensional cut-away view of the inside of a pre-packaged modular machine room according to another embodiment of the invention.

FIGS. 8, 9 and 12 are three dimensional cutaway perspective views of the inside of a pre-packaged modular machine room and condenser unit according to an embodiment of the invention, in which all the elements of the low charge packaged refrigeration system are contained in an integrated unit, except the evaporator. As discussed herein, the evaporator may be housed in a penthouse module, or it may be suspended in the refrigerated space, preferably directly below the location of the machine room module. According to these embodiments, the evaporator is configured to directly cool air which is in or supplied to a refrigerated space.

According to alternative embodiments (e.g., in which end users to not wish refrigerated air to come into contact with ammonia-containing parts/tubing), the evaporator may be configured as a heat exchanger to cool a secondary non-volatile fluid, such as water or a water/glycol mixture, which secondary non-volatile fluid is used to cool the air in a refrigerated space. In such cases, the evaporator may be mounted inside the machine room.

Figure 13:
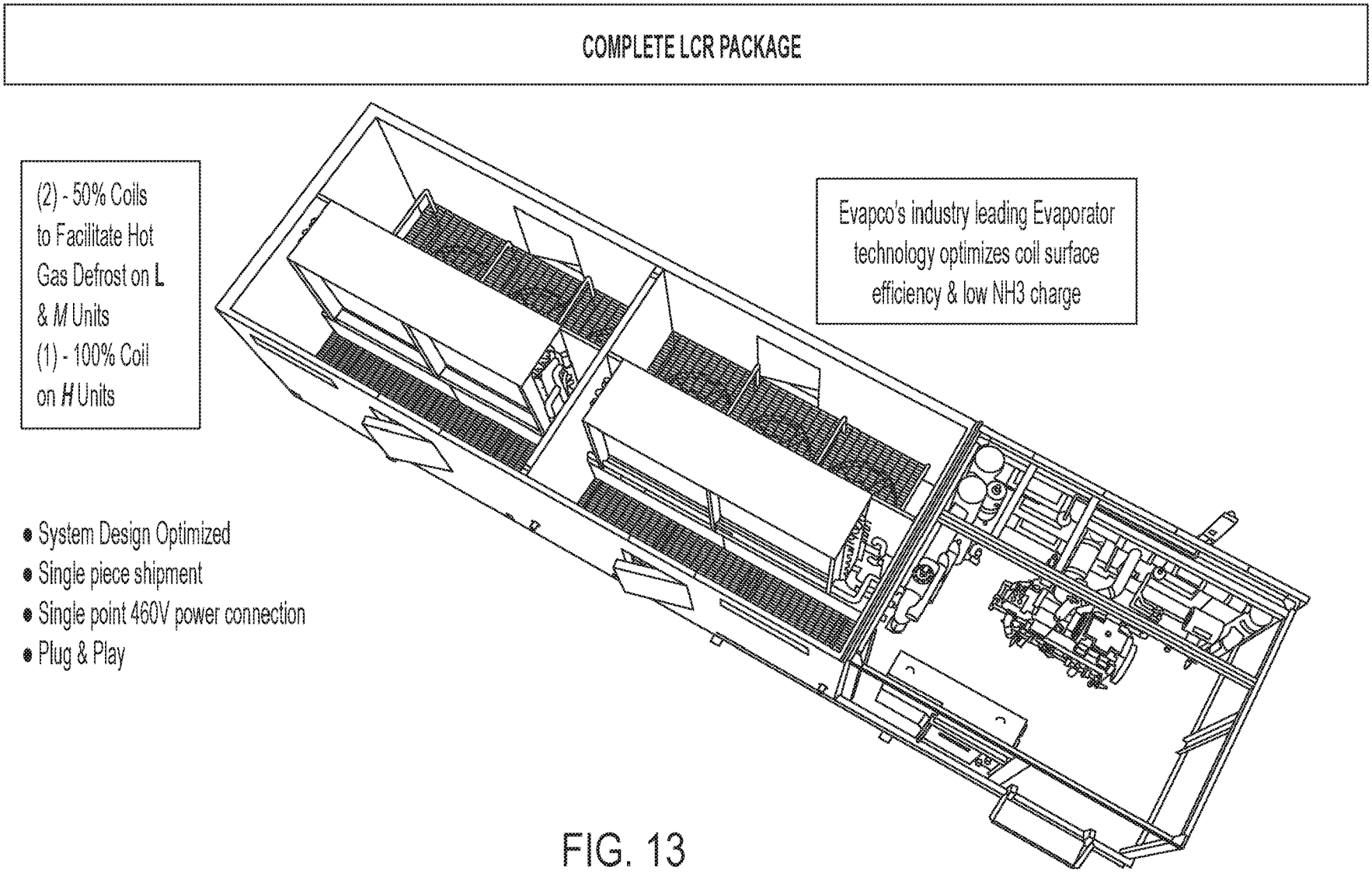
FIG. 13 shows a three-dimensional cut-away view of the inside of a combined penthouse evaporator module and a prepackaged modular machine room.

FIG. 13 is a cutaway three-dimensional perspective view of the inside of a combined penthouse evaporator module and a prepackaged modular machine room.

The combination of features as described herein provides a very low charge refrigeration system compared to the prior art. Specifically, the present invention is configured to require less than six pounds of ammonia per ton of refrigeration capacity. According to a preferred embodiment, the present invention can require less than four pounds of ammonia per ton of refrigeration. And according to most preferred embodiments, the present invention can operate efficiently with less than two pounds per ton of refrigeration capacity. By comparison, prior art "stick-built" systems require 15-25 pounds of ammonia per ton of refrigeration, and prior art low charge systems require approximately 10 pounds per ton of refrigeration. Thus, for a 50 ton refrigeration system, prior art stick built systems require 750-1, 250 pounds of ammonia, prior art low charge systems require approximately 500 pounds of ammonia, and the present invention requires less than 300 pounds of ammonia, and preferably less than 200 pounds of ammonia, and more preferably less than 100 pounds of ammonia, the report threshold for the EPA (assuming all of the ammonia in the system were to leak out. Indeed according to a 50 ton refrigeration system of the present invention, the entire amount of ammonia in the system could be discharged into the surrounding area without significant damage or harm to humans or the environment.

While the present invention has been described primarily in the context of refrigeration systems in which ammonia is the refrigerant, it is contemplated that this invention will have equal application for refrigeration systems using other natural refrigerants, including carbon dioxide.

The description of the invention is merely exemplary in nature and, thus, variations that do not depart from the concept of a packaged (one-or two-module integrated and compact system) low refrigerant charge (i.e., less than 10 lbs of refrigerant per ton of refrigeration capacity) refrigeration system are intended to be within the scope of the invention. Any variations from the specific embodiments described herein but which otherwise constitute a packaged, pumped liquid, recirculating refrigeration system with charges of 10 lbs or less of refrigerant per ton of refrigeration capacity should not be regarded as a departure from the spirit and scope of the invention set forth in the following claims.

The invention claimed is:

1. A refrigeration system comprising:

a refrigerant condenser; and a transportable pre-fabricated modular refrigeration machine room sized to allow entry of a technician therein for servicing, said transportable pre-fabricated modular refrigeration machine room containing:

a vapor/liquid separation structure configured to be connected to an outlet of an evaporator via refrigerant line;

a refrigerant compressor connected to an outlet of said vapor/liquid separation structure via refrigerant line and connected to an inlet of said condenser via refrigerant line;

a collection vessel connected to an outlet of said refrigerant condenser via refrigerant line;

refrigerant line connecting an outlet of said collection vessel to an inlet of said vapor/liquid separation structure;

wherein said vapor/liquid separation structure has an outlet that is configured to be connected via refrigerant line to an inlet of an evaporator;

said refrigeration system further comprising refrigerant in an amount of less than six pounds of refrigerant per ton of refrigeration capacity.

2. A refrigeration system according to claim 1, further comprising an evaporator connected to an inlet of said vapor/liquid separation structure and connected to an outlet of said vapor/liquid separation structure.

3. A refrigeration system according to claim 2, wherein said evaporator is mounted in a prefabricated modular evaporator room.

4. A refrigeration system according to claim 2, wherein said evaporator is mounted in a refrigerated space adjacent to or below said transportable pre-fabricated refrigeration modular machine room.

5. A refrigeration system according to claim 1, further comprising a recirculator pump situated in a refrigerant flow path between a fluid outlet of said vapor/liquid separation structure, and an inlet of an evaporator.

6. A refrigeration system according to claim 1, wherein said condenser is an air-cooled condenser comprising coils and a fan that are configured to be mounted on top of said transportable prefabricated modular refrigeration machine room.

* * * * *